US005173059A

United States Patent [19]

Sato et al.

[11] Patent Number: 5,173,059

[45] Date of Patent: Dec. 22, 1992

[54] LOCK MECHANISM OF INNER LOCK TYPE FOR ELECTRICAL CONNECTOR

[75] Inventors: Kensaku Sato; Naohisa Nakata, both of Tokyo, Japan

[73] Assignee: Hirose Electric Co., Ltd., Tokyo, Japan

[21] Appl. No.: 731,788

[22] Filed: Jul. 19, 1991

[30] Foreign Application Priority Data

Jul. 20, 1990 [JP] Japan ..... 2-76544[U]

[51] Int. Cl.[5] ..... H01R 13/627

[52] U.S. Cl. ..... 439/354; 439/357

[58] Field of Search ..... 439/350–355, 439/357, 358, 344, 347, 552, 557

[56] References Cited

U.S. PATENT DOCUMENTS

| | | | |
|---|---|---|---|
| 3,409,859 | 11/1968 | Krehbiel | 439/357 |
| 3,523,269 | 8/1970 | Witek, Jr. et al. | 439/358 |
| 4,406,509 | 9/1983 | Jagen | 439/354 |
| 4,458,973 | 7/1984 | Hayes et al. | 439/347 |

*Primary Examiner*—Larry I. Schwartz
*Assistant Examiner*—Hien D. Vu
*Attorney, Agent, or Firm*—Kanesaka & Takeuchi

[57] ABSTRACT

An electrical connector consisting of a connector socket (1) having a rectangular socket block (3) and a connector plug (2) having a rectangular plug block (13). The rectangular socket block includes a pair of lock recesses (8) on opposite sides thereof, each having a pair of lock shoulders (9, 10) and a cutout (11) in a front portion thereof; and a pair of sloped surfaces (12) in opposite front sides thereof. The rectangular plug block includes a pair of lock arms (14) having a base portion (15*a*) extending backwardly from front ends of opposite sides of the plug block and a front portion (15*b*) extending backwardly and outwardly from the base portion, the base portions having a pair of lock projections (18, 19); a pair of lock arm receiving recesses (20) formed on opposite sides of the plug block; and a pair of end projections (21) extending outwardly from a rear end of the plug block to define an end of the lock arm receiving recesses.

5 Claims, 5 Drawing Sheets

LOCK MECHANISM OF INNER LOCK TYPE FOR ELECTRICAL CONNECTOR

BACKGROUND OF THE INVENTION

1. Field of the Invention

The present invention relates generally to electrical connectors to be connected to ribbon or flat cables and, more particularly, to a lock mechanism for such electrical connectors.

2. Description of the Prior Art

FIG. 12 shows a conventional electrical connector of this type. A connector plug c is connected and locked to a connector socket a by engaging a lock arm f of the plug c with a lock shoulder e of the socket a so that the pin receiving apertures b of the connector socket a receive the contact pins g of the connector plug c for providing electrical continuation.

In the conventional electrical connector, however, the lock arms f project outwardly, increasing the size of the connector plug c. In addition, this lock mechanism d of the outer lock type in which the lock arms f engage the lock shoulders e of the socket a is not only very sensitive to vibrations but also very difficult to release in limited spaces.

SUMMARY OF THE INVENTION

Accordingly, it is an object of the invention to provide a compact electrical connector.

It is another object of the invention to provide an electrical connector of the inner lock type which is not only resistant to vibrations but also easy to release in limited spaces.

According to the invention there is provided an electrical connector consisting of a connector socket having a rectangular socket block and a connector plug having a rectangular plug block. The rectangular socket block includes a pair of lock recesses on opposite sides thereof, each having a pair of lock shoulders and a cutout in a front portion thereof; and a pair of sloped surfaces in opposite front sides thereof. The rectangular plug block includes a pair of lock arms having a base portion extending backwardly from front ends of opposite sides of the plug block and a front portion extending backwardly and outwardly from the base portion, the base portions having a pair of lock projections; a pair of lock arm receiving recesses formed on opposite sides of the plug block; and a pair of end projections extending outwardly from a rear end of the plug block to define an end of the lock arm receiving recesses.

To connect the connector plug to the connector socket, the lock arms are depressed with two fingers to put in the lock arm receiving recesses, thereby reducing the width of the connector plug, resulting in the reduced connector size. The lock arms are inserted into the lock recesses without resistance and, when released, flex outwardly so that the lock projects engage the lock shoulders to lock the connector plug to the connector socket. Since the lock mechanism is of the inner lock type that lock projects engage the lock shoulder within the lock recesses, it is resistant to vibrations.

When the connector plug is connected to the connector socket, the front portions of the lock arms project through the cutouts of the connector socket while the sloped surfaces of connector socket provides indentations sufficiently large to receive the fingers. Consequently, when the lock arms are depressed, the fingers rest in the indentations and engage the end projections of the connector socket so that it is easy to pull the connector plug out of the connector socket.

The above and other objects, features, and advantages of the invention will more apparent from the following description when taken in conjunction with the accompanying drawings.

DESCRIPTION OF THE PREFERRED EMBODIMENT

Figure 1:
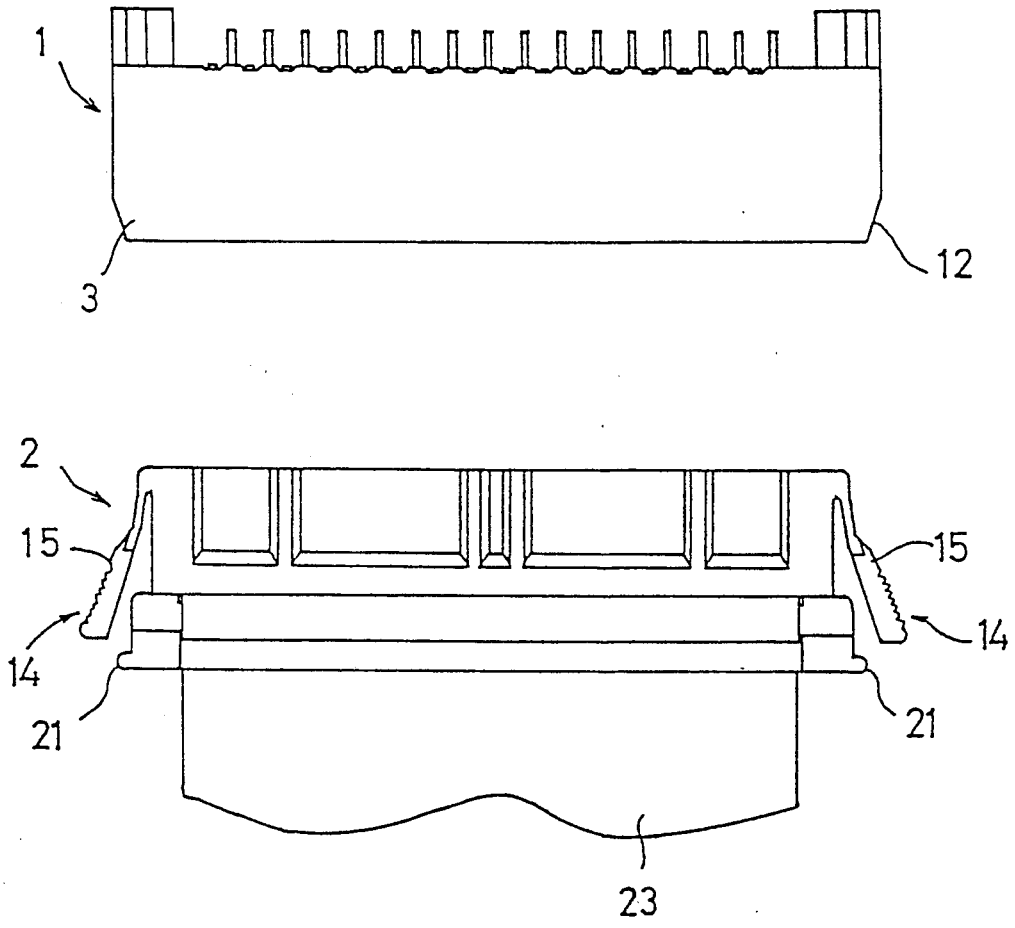
FIG. 1 is a top plan view of an electrical connector according to an embodiment of the invention of which the connector plug and the connector socket are unplugged.
Figure 2:
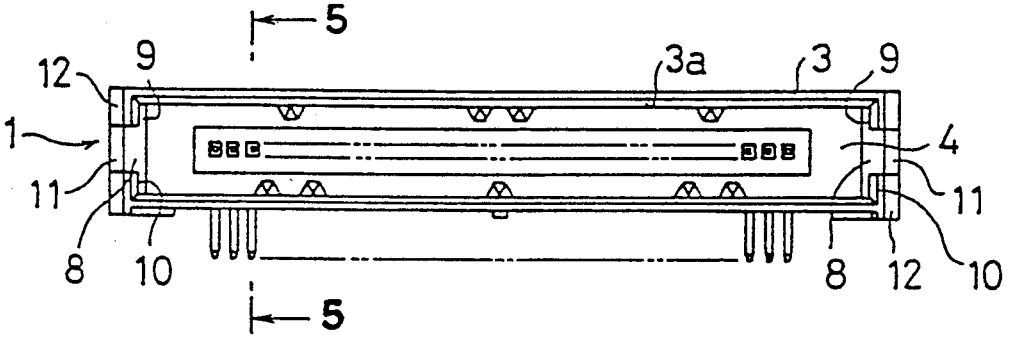
FIG. 2 is a front elevational view of the connector socket.
Figure 3:
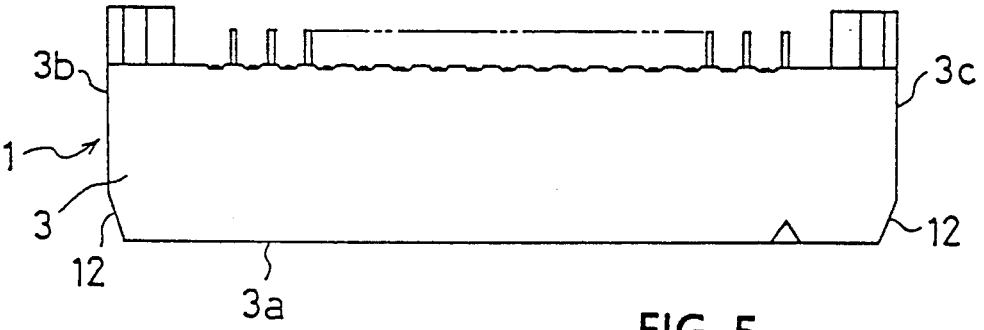
FIG. 3 is a top plan view of the connector socket.
Figure 4:
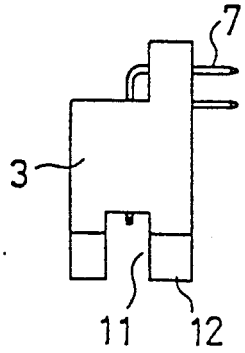
FIG. 4 is a side elevational view of the connector socket.

In FIG. 1, an electrical connector consists of a connector socket 1 which is to be mounted on a board and a connector plug 2 which is to be connected to the connector socket I.

In FIGS. 2–5, the connector socket 1 includes a socket block 3 made from a synthetic resin so as to have a plug cavity 4 which opens in the front end 3*a*. A number of terminals 5 are arranged at regular intervals lengthwise of the plug cavity 4. The contact portion 6 of each terminal 5 projects into the plug cavity 4 from the terminal support portion 4*a* of the socket block 3. The leg portion 7 of each terminal 5 projects outwardly from the rear wall 3*d* of the socket block 3 and is bent downwardly at right angles. A pair of lock recesses 8 each having a pair of lock shoulders 9 and 10 are formed on opposite side walls 3*b* and 3*c* of the socket block 3. Each side wall has a central cutout 11 in the front portion and a sloped surface 12.

In FIGS. 6–11, the connector plug 2 includes a plug block 13 which is molded from a synthetic resin so as to have a pair of lock mechanisms 14 on opposites side walls 13*a*. The lock mechanism 14 has a lock arm 15 which extends backwardly from the front end of the side wall 13*a*. The lock arm 15 has a base portion 15*a* which extends parallel with the axis 88 and a front portion 15*b* which extends outwardly with respect to the axis 88. The front portion 15*b* is made thicker than the base portion 15*a* and is knurled on the outside 16 for preventing the finger from slipping. A pair of lock projections 18 and 19 are formed on opposite sides of the base portion 15*a*. A pair of lock arm receiving recesses 20 are formed on the side walls 13*a* (FIG. 11) for receiving the front portions 15*b* of the lock arms 15. A pair of end projections 21 project outwardly from the rear end of the plug block 13 providing the lock arm receiving recesses 20 with an end wall. A number of contact terminals 22 are arranged at regular intervals lengthwise of the plug block 13 and connected to a flat cable 23.

Figure 5:
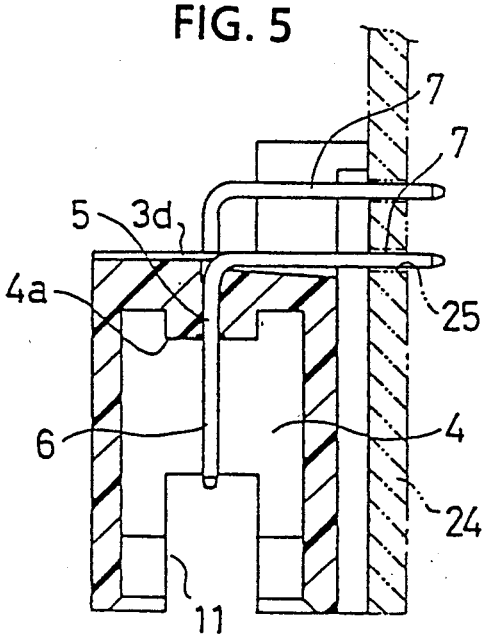
FIG. 5 is a sectional view taken along line 5—5 of FIG. 2.
Figure 6:
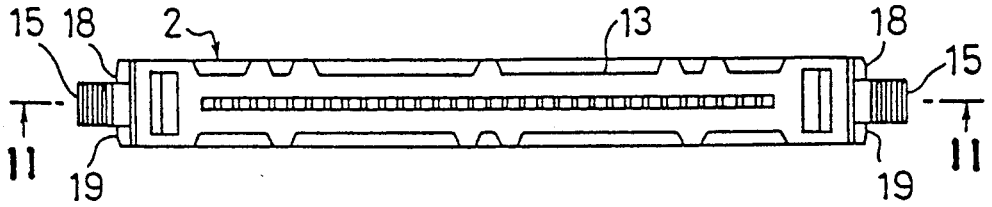
FIG. 6 is a front elevational view of the connector plug.
Figure 7:
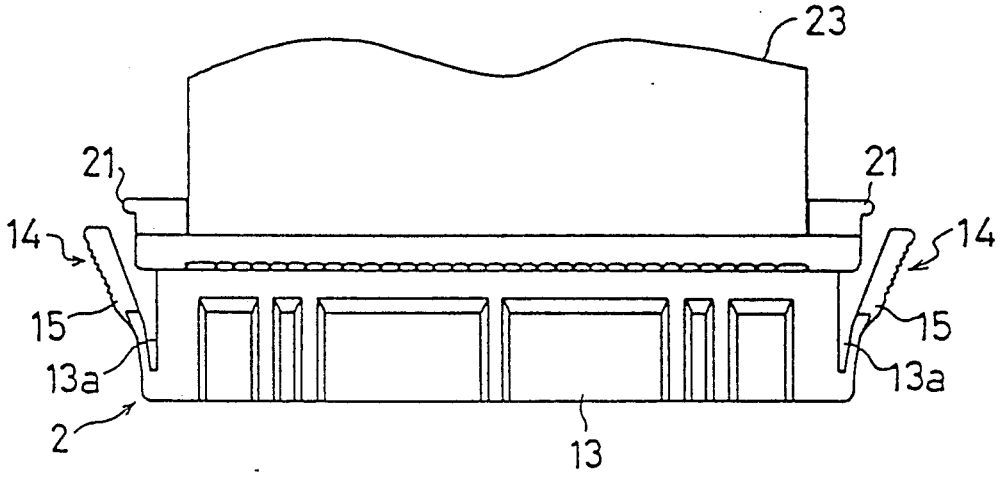
FIG. 7 is a top plan view of the connector plug.
Figure 8:
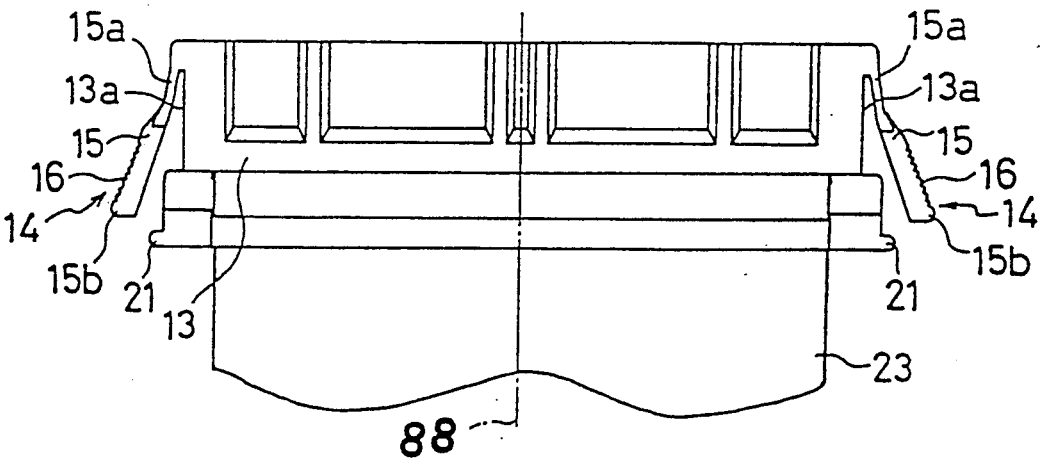
FIG. 8 is a bottom plan view of the connector plug.
Figure 9:
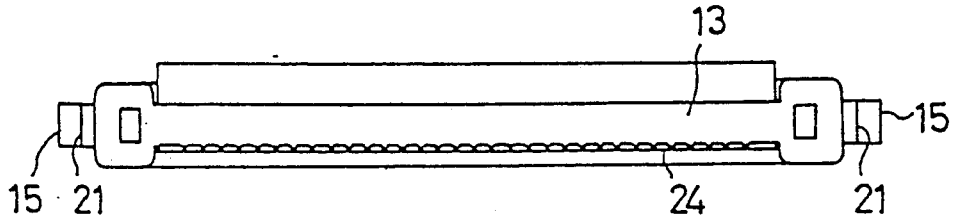
FIG. 9 is a rear elevational view of the connector plug.
Figure 10:
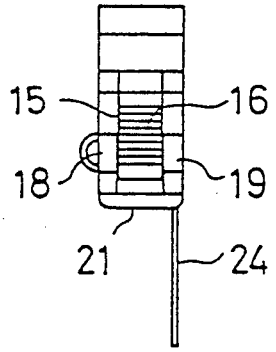
FIG. 10 is a side elevational view of the connector plug.
Figure 11:
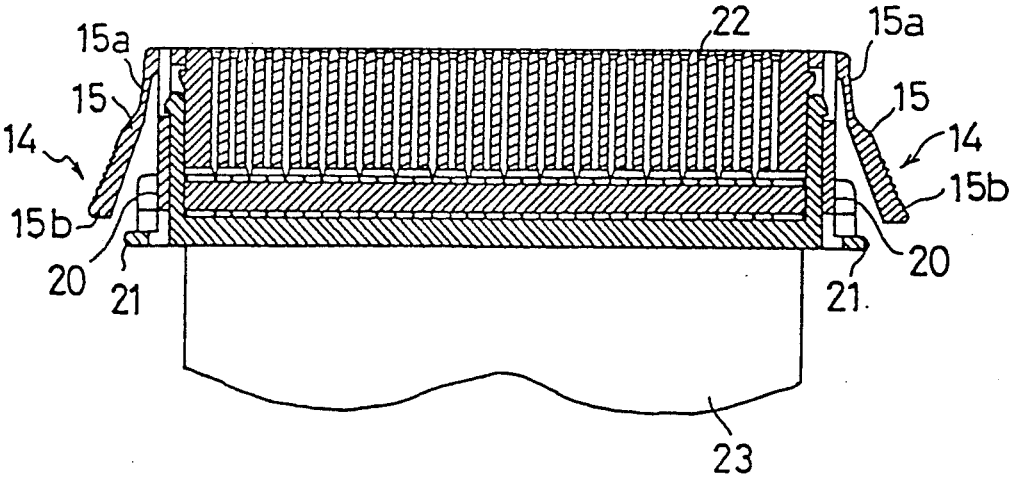
FIG. 11 is a sectional view taken along line 11—11 of FIG. 6.
Figure 12:
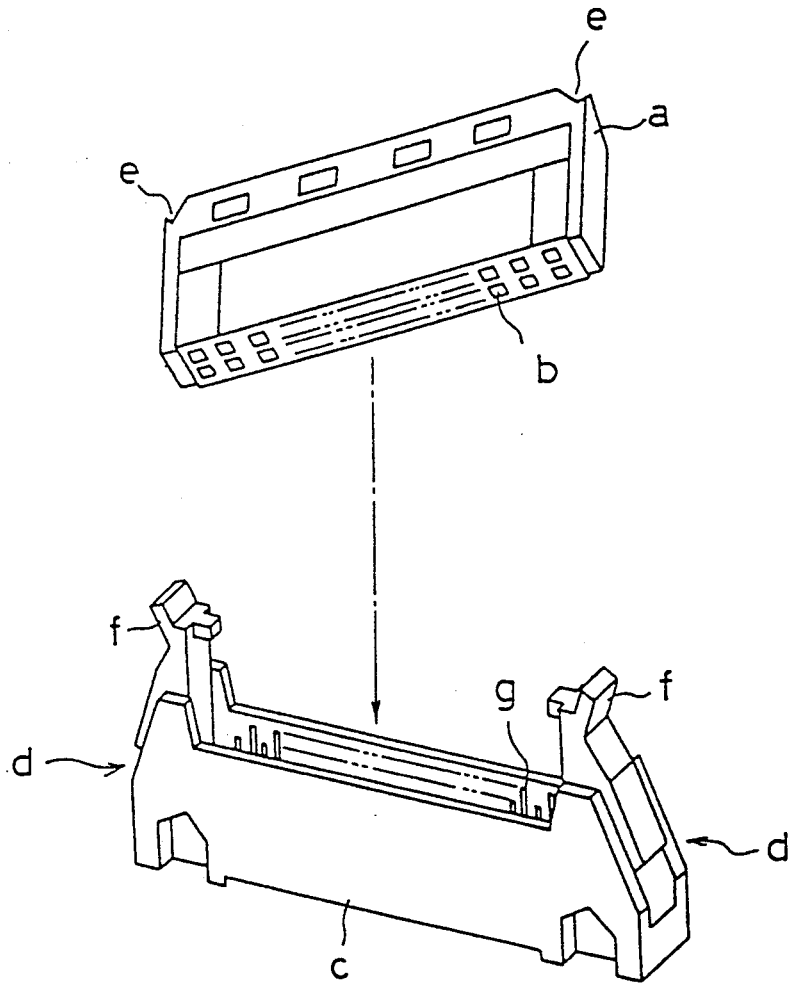
FIG. 12 PRIOR ART
FIG. 12 is a exploded perspective view of a conventional electrical connector.

Best shown in FIG. 5, the connector socket 1 is mounted on a board 24 by soldering the leg portions 6 of the terminals 5 to the through holes 25. The connector plug 2 is fitted into the plug cavity 4 of the connector socket 1 so that the contact terminals 22 are brought into contact with the contact portions 6 of the terminals 5 for providing electrical continuity.

Before the connector plug 2 is inserted into the connector cavity 4, the lock arms 15 of the lock mechanisms 14 are depressed with two fingers to put them in the lock arm receiving recesses 20 so that the lock arms 15 are inserted into the lock recesses 8 without resistance. After insertion, the fingers are removed to release the lock arms 15 so that they flex outwardly with their own elasticity. Consequently, the lock projections 18 and 19 engage the lock shoulders 9 and 1? to lock the connector plug 2 to the connector socket 1.

When the connector plug 2 is connected to the connector socket 1, the front portions 15*b* of the lock arms 15 are protruded through the cutouts 11 of the connector socket 1, and the sloped surfaces 12 provide indentations sufficiently large to put the fingers therein.

To disconnect the connector plug 2 from the connector socket 1, the front portions 15*b* of the lock arms 15 are depressed with two fingers to put them in the lock arm receiving recesses 20, thereby releasing the lock projections 18 and 19 from the lock shoulders 9 and 10 for removal of the connector plug 2 from the connector socket 1. When the front portions 15*b* are depressed with the fingers, the fingers rest in the indentations of the sloped surfaces 12 of the connector socket I coming into contact with the end projections 21. This makes it easy to pull the connector plug 2 out of the connector socket 1.

As has been described above, with the electrical connector according to the invention, it is possible to reduce the width of the connector plug 2, thus minimizing the size of the electrical connector. Since the lock arms 15 are depressed into the receiving recesses 20 before locking, it is possible to insert the lock arms 15 into the lock recesses 8 without resistance. When released, the lock arms 15 flex outwardly so that the lock projections 18 and 19 of the lock arms 15 engage the lock shoulders 9 and 10 of the connector socket 1 to lock the connector plug 2 to the connector socket 1. This lock mechanism of the inner lock type in which the lock arms 15 engage within the lock recesses 20 is resistant to vibrations.

When the connector plug 2 is connected to the connector socket 1, the front portions of the lock arms 15 project through the cutouts 11 of the connector socket 1 while the sloped surfaces 12 provide indentations which are sufficiently large to receive the fingers. Thus; it is easy to pull the connector plug 2 out of the connector socket 1 because when the lock arms 15 are depressed, the fingers rest in the indentations of the sloped surfaces 12 of the connector socket 1 so that they engage the end projections 21 of the plug connector 2 without difficulty.

What is claimed is:

1. An electrical connector consisting of a connector socket having a rectangular socket block having a rectangular cavity and a connector plug having a rectangular plug block designed to fit into said rectangular cavity;

said rectangular socket block comprising:

a pair of lock recesses formed on insides of opposite side walls of said socket block thus forming an inner-lock type connector socket, each having a pair of lock shoulders and a central cutout formed through each of said side walls in a front portion thereof; and a pair of sloped outer surfaces in opposite front portions of said side walls;

said rectangular plug block comprising:

a pair of lock arms having a base portion extending backwardly from front ends of opposite side walls of said plug block and a front portion extending backwardly and outwardly from said base portion, said base portions having a pair of lock projections for engagement with said lock shoulders of the lock recesses with the lock arm extending through the central cutouts.

2. The electrical connector of claim 1, wherein said plug block further comprises:

a pair of lock arm receiving recesses formed on opposite sides of said plug block for receiving said front portions of said lock arms; and a pair of end projections extending outwardly from a rear end of said plug block to define an end of said lock arm receiving recesses.

3. A lock mechanism of an inner lock type for an electrical connector which consists of a connector socket having a rectangular socket block with a rectangular cavity therein and a connector plug having a rectangular plug block designed to fit into said rectangular cavity, said lock mechanism comprising:

a pair of lock recesses formed on insides of opposite side walls of said socket block, each having a pair of lock shoulders and a central cutout in a front end portion thereof;

a pair of flexible lock arms extending backwardly from front ends of said opposite side walls of said plug block and having a pair of lock projections for engagement with said lock shoulders;

a pair of lock arm receiving recesses formed on said opposite sides for receiving said flexible lock arms when depressed so that said flexible lock arms are inserted into said lock recesses without resistance and flex back when released to engage said lock shoulders, thereby locking said connector plug to said connector socket with the lock arm extending through the central cutouts.

4. The lock mechanism of claim 2, wherein said socket block further comprises a pair of sloped outer surface of said side walls thereby facilitating releasing said lock arms from said lock recesses.

5. The lock mechanism of claim 2, wherein said lock mechanism further comprises a pair of lock arm receiving recesses formed on said opposite side walls for receiving free ends of said flexible lock arms when depressed so that said flexible lock arms are inserted into said lock recesses without resistance and flex back when released to engage said lock shoulders, thereby locking said connector plug to said connector socket.

* * * * *